US009033564B2

(12) United States Patent
Gerhard et al.

(10) Patent No.: US 9,033,564 B2
(45) Date of Patent: May 19, 2015

(54) HIGH PRESSURE DISCHARGE LAMP

(75) Inventors: Markus Gerhard, Aachen (DE); Nathijs De Wit, Ijsselstein (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 587 days.

(21) Appl. No.: 12/530,542

(22) PCT Filed: Mar. 7, 2008

(86) PCT No.: PCT/IB2008/050839

§ 371 (c)(1), (2), (4) Date: Sep. 9, 2009

(87) PCT Pub. No.: WO2008/110969

PCT Pub. Date: Sep. 18, 2008

(65) Prior Publication Data

US 2010/0053989 A1 Mar. 4, 2010

(30) Foreign Application Priority Data

Mar. 12, 2007 (EP) ..... 07103922

(51) Int. Cl.

| | |
|---|---|
| ***F21V 7/04*** | (2006.01) |
| ***H01J 5/60*** | (2006.01) |
| ***H01J 5/52*** | (2006.01) |
| ***H01J 5/56*** | (2006.01) |
| ***H01J 61/86*** | (2006.01) |

(52) U.S. Cl.

CPC ... *H01J 5/60* (2013.01); *H01J 5/52* (2013.01); *H01J 5/56* (2013.01); *H01J 61/86* (2013.01)

(58) Field of Classification Search

CPC ..... H01J 5/52; H01J 5/56; H01J 5/60; H01J 61/86

USPC ..... 362/263–265, 547–549

See application file for complete search history.

(56) References Cited

U.S. PATENT DOCUMENTS

| | | | |
|---|---|---|---|
| 4,547,838 | A | 10/1985 | Wakimizu |
| 4,769,574 | A | 9/1988 | Nagasawa et al. |
| 4,879,491 | A | 11/1989 | Hirozumi et al. |
| 5,742,114 | A | 4/1998 | Kohl et al. |
| 6,031,323 | A | 2/2000 | Behr et al. |
| 6,254,252 | B1 | 7/2001 | Coushaine et al. |
| 6,294,861 | B1 | 9/2001 | Mochiduki |
| 7,119,483 | B2 | 10/2006 | Westemeyer et al. |
| 2005/0127807 | A1 | 6/2005 | Arndt |

FOREIGN PATENT DOCUMENTS

| | | |
|---|---|---|
| EP | 0367343 A2 | 5/1990 |
| EP | 1439569 A2 | 7/2004 |

*Primary Examiner* — Jason Moon Han

(57) ABSTRACT

A high pressure discharge lamp (10), which is particularly a motor vehicle headlight, comprises a high pressure discharge burner (12) for emitting light supported by at least one leg (24), preferably three or four legs (24). By means of the legs (24) the burner (12) is mechanically connected to a socket (14) of the high pressure discharge lamp (10). According to the invention the legs (24) are part of a holder (16), which comprises further a ring (18) surrounding the socket (14), whereby the ring (18) is one-piece with the legs (24). Due to the design of the holder (16) as ring (18) with protruding legs (24) the heat of the burner (12) is conducted from the burner (12) via the legs (24) to the ring (18) by heat conduction. From the ring (18) the heat is led away to the environment by convection. This leads to a significant cooler Temperature of the holder (16) with respect to the burner (12), so that the material of the socket (14) needs not to be selected with respect to a good heat resistance. Thus, the use of more cost efficient materials is possible to deal with the hot burner (12).

15 Claims, 3 Drawing Sheets

HIGH PRESSURE DISCHARGE LAMP

FIELD OF THE INVENTION

The invention relates to the field of high pressure discharge lamps, and more specifically to a motor vehicle headlight.

BACKGROUND OF THE INVENTION

In U.S. Pat. No. 7,119,483 B2 a high pressure discharge lamp is disclosed, which can be used as motor vehicle headlight. The high pressure discharge lamp comprises a burner held by three or four metal legs, which are inserted into a socket made of plastic material. Since the burner of a high pressure discharge lamp becomes very hot during use in comparison to other types of lamps like halogen lamps the plastic material of the socket is selected with respect to a good heat resistance, for instance PPS (polyphenylene sulfide, $(SC_6H_4)_n$).

There is a permanent need to reduce production costs of the manufacture of high pressure discharge lamps.

SUMMARY OF THE INVENTION

It is an object of the invention to provide a high pressure discharge lamp, which is able to deal with a hot burner in a more cost efficient manner.

This object is achieved by the features of claim 1. Preferred embodiments of the invention are given by the dependent claims.

The high pressure discharge lamp according to the invention, which is particularly a motor vehicle headlight, comprises a high pressure discharge burner for emitting light supported by at least one leg, preferably three or four legs. By means of the legs the burner is mechanically connected to a socket of the high pressure discharge lamp. According to the invention the legs are part of a holder, which comprises further a ring surrounding the socket, whereby the ring is one-piece with the legs.

Due to the design of the holder as ring with protruding legs the heat of the burner is conducted from the burner via the legs to the ring by heat conduction. From the ring the heat is led away to the environment by convection. This leads to a significant cooler temperature of the holder with respect to the burner, so that the material of the socket needs not to be selected with respect to a good heat resistance. Thus, the use of more cost efficient materials is possible to deal with the hot burner leading to reduced manufacturing costs. Due to the reduced temperature of the holder in the ring area it is safeguarded that applied heat is not sufficient for the socket, the material inside the socket or plastic components of the lamp to partially gas out. Since an outgasing inside the lamp is prevented it is prevented that outgased components condense at a glass body of the burner. This improves the optical performance of the lamp over the life-time of the lamp. Further the operating temperature of the burner can be reduced, so that the life-time of the burner and thus the life time of the high pressure discharge lamp increase. Since the holder is preferably made from a metal material the holder improves the electromagnetic shied performance. Thus, it is possible to provide a significant increased voltage for the burner increasing the light radiation without increasing the electromagnetic radiation to the environment.

Preferably the legs of the holder are connected to the ring significantly spaced to the burner, so that a distinct heat transfer from the legs to environment by convection may occur. Particularly the ring comprises an inner surface, which radially points towards the socket. The legs extend from the burner to nearly the same radius of the inner surface. Thus, the legs protrude from the ring next to the inner surface. When the legs are formed as clamping springs for clamping the burner prior to a fixation the legs extend diagonally, so that the legs provide an increased area for leading away the heat of the burner by convection.

Further the ring may comprise a cooling surface, by which the holder may lead away heat by convection. Preferably the cooling surface points axially and comprises a significant area, particularly greater than the radially pointing surfaces of the ring. This means the ratio of the area of the cooling surface to the area of the radially pointing surfaces, particularly side faces, of the ring is ≥0.5, particularly ≥1.0, preferably ≥2.5, most preferred ≥3.5. Further the ring may comprise a cooling rip, which generally may point in any direction for increasing the cooling effect of the holder.

In a preferred embodiment the socket comprises at least one recess. By means of the recess at least one of the legs can be accommodated and arranged at least partially inside the recess. Due to the recess the leg can be guided through the socket without contacting the socket. Thus, a compact design is possible leading to a reduced overall size, whereby a sufficient cooling of the burner is safeguarded.

The socket comprises preferably a metal housing to which the holder is thermally connected. Due to the thermal connection the surface of the metal housing is used for cooling the burner. This significantly increases the cooling area. For example the metal housing of the socket may protrude upwards, so that the ring of the holder surrounds the protrusion of the metal housing in the assembled state. This preferably leads to a metal/metal contact between the holder and the housing of the socket, so that a good thermal connection is provided. Further the electromagnetic shield performance is increased.

Preferably the holder is fixed to the housing of the socket for instance by crimping. Most preferred the holder and the housing are one-piece. In the one-piece embodiment the upper part of the housing is the ring of the holder surrounding the inner part of the socket. The inner part of the socket is generally made of an electrically insulating material for preventing a short circuit due to the high applied voltage of normally more than 10 000 Volt. The legs may protrude directly from the upper part of the housing i.e. the ring of the holder.

The invention further relates to a method of manufacturing a high pressure discharge lamp as previously described. Due to the method according to the invention the holder and/or the housing are made from a metal sheet by stamping and forming. It is not necessary to provide a lot of different materials. Especially it is possible to save PPS. Preferably the holder and the housing are one-piece, so that the holder and the housing may be obtained by a single stamping step followed by several forming steps. In the case that the holder and the housing are not one-piece it is preferred to connect the holder to the housing by crimping. The burner may be connected to the holder by welding, particularly laser welding, after the intended alignment of the burner with respect to the socket is obtained.

BRIEF DESCRIPTION OF THE DRAWINGS

These and other aspects of the invention will be apparent from and elucidated with reference to the embodiments described hereinafter. In the drawings.

DETAILED DESCRIPTION OF EMBODIMENTS

Figure 1:
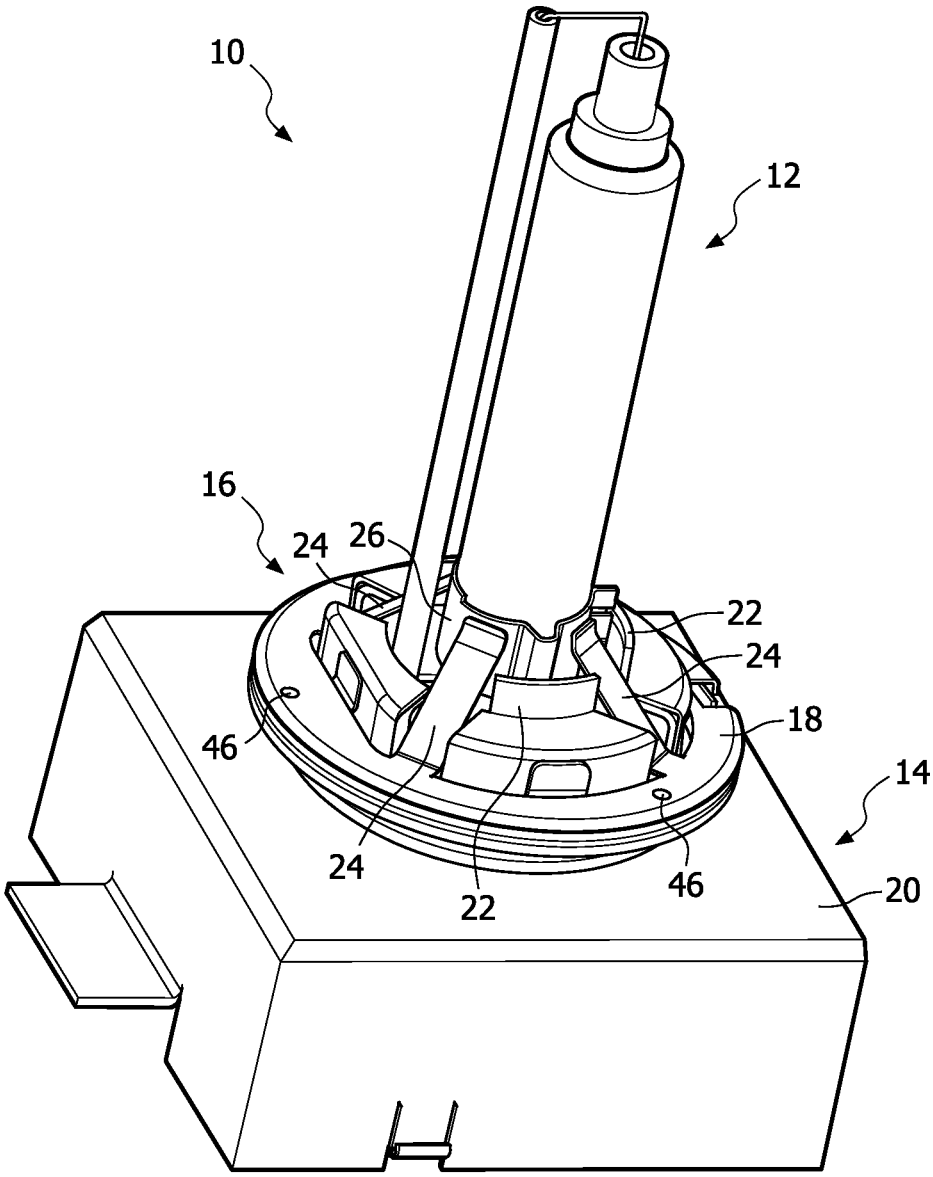
FIG. 1 is a drawn to scale perspective view of a high pressure discharge lamp according to the invention.

The high pressure discharge lamp 10 illustrated in FIG. 1 comprises a high pressure discharge burner 12 connected to a socket 14 via a holder 16. The holder 16 comprises a ring 18 surrounding the socket 14. In the illustrated embodiment the socket 14 comprises a metal housing 20, which comprises protrusions 22 protruding upwards and being surrounded by the ring 18 of the holder 16. One-piece with the ring 18 are four legs 24 for holding the burner 12. The burner 12 comprises a bush 26 to which the legs 24 are fixed by laser welding.

Figure 2:
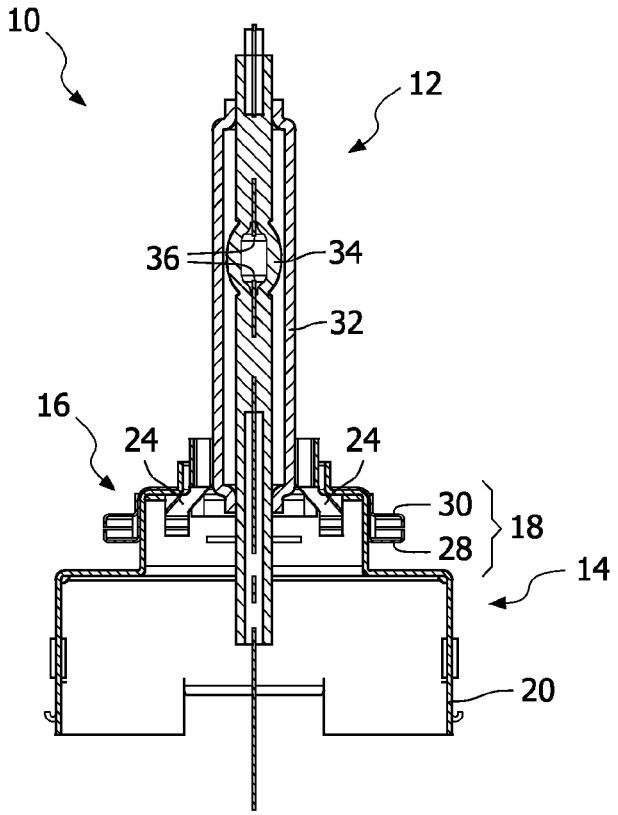
FIG. 2 is a drawn to scale sectional side view of the high pressure discharge lamp illustrated in FIG. 1.

As can be derived from FIG. 2 the holder 16 comprises an inner (lower) part 28 and an outer (upper) part 30, which together forms the ring 18 and may connected to each other by crimping. In the illustrated embodiment the legs 24 are one-piece with the outer part 30 of the ring 18. Due to the inner part 28 of the ring 18 the connection of the holder 16 with the housing 20 of the socket 14 is facilitated. Generally, it is possible to omit the inner part 28 of the ring 18 or to provide the inner part 28 and the outer part 30 as one-piece.

The burner 12 comprises a glass body 32 which accommodates a discharge vessel 34 mainly filled with Xenon. Two electrodes 36 end inside the discharge vessel 34. When a voltage of normally more than 10 000 Volt is applied to the electrodes a light beam is provided between the electrodes 36, so that light is emitted from the burner 12. The lower part of the burner 12 is accommodated by an insulating material of the socket 14 not illustrated for sake of clarity. Further electronic circuits and connectors may be arranged inside the housing 20 of the socket 14.

Figure 3:
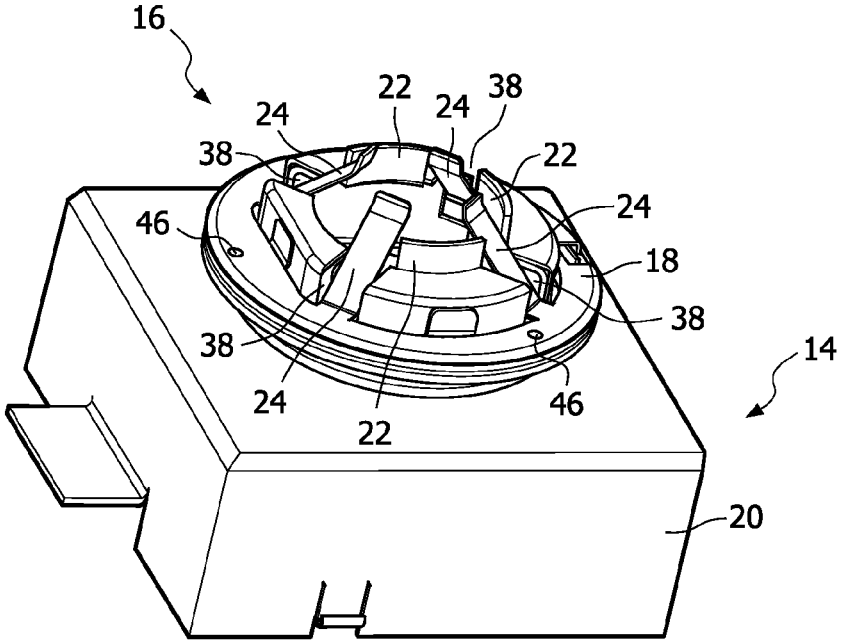
FIG. 3 is a drawn to scale sectional view of a socket and a holder of the high pressure discharge lamp illustrated in FIG. 1.

As can be derived from FIG. 3 the socket 14 comprises recesses 38 provided between the protrusions 22 of the housing 20. In each recess 38 at least one leg 24 is arranged.

Figure 4:
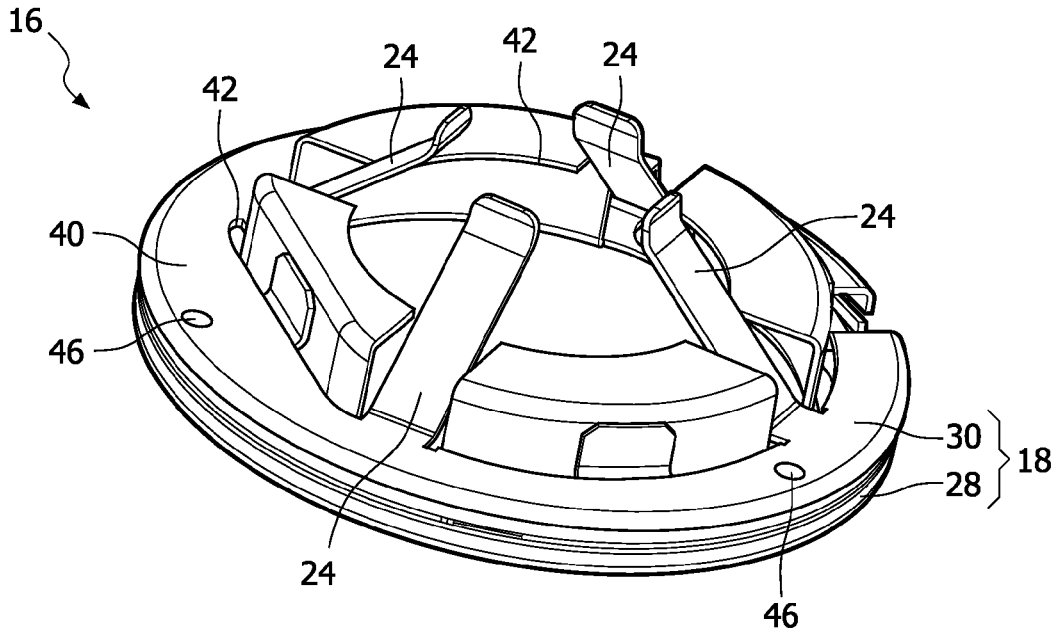
FIG. 4 is a drawn to scale sectional view of the holder illustrated in FIG. 3
Figure 5:
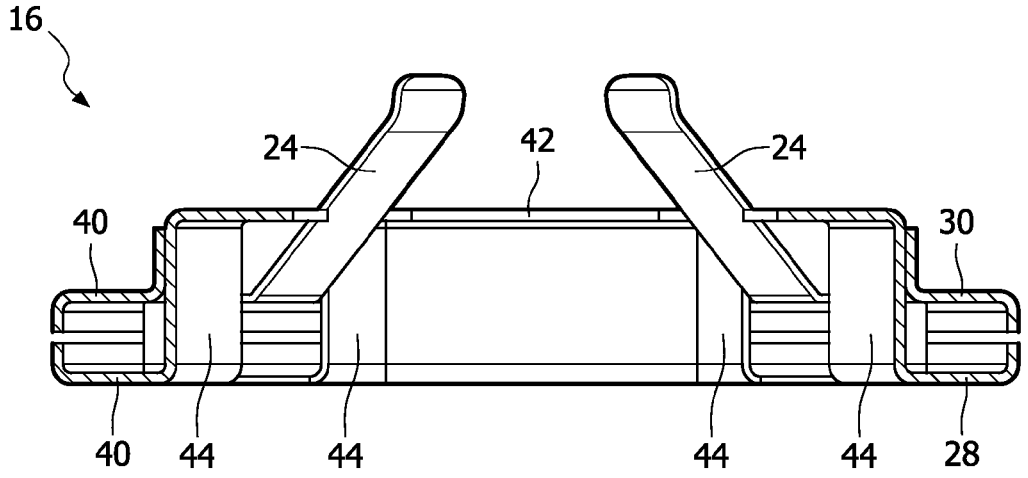
FIG. 5 is a drawn to scale sectional side view of the holder illustrated in FIG. 4.

In order to increase the cooling effect of the holder 16 the ring 18 comprises a cooling surface 40 which points in axial direction. It is possible to provide the ring 18 further with a cooling rip. In the embodiment illustrated in FIG. 4 and FIG. 5 the ring 18 itself of the holder 16 is designed like a cooling rip. This means the area of the cooling surfaces 40 provided by the outer part 30 on the top and by the inner part 28 on the bottom is greater than the area of side surfaces 42 of the holder 16. Further the ring 18 may be in plane contact to the housing 20 of the socket 14 via a contacting surface 44. In the illustrated embodiment the contacting surface 44 is part of the inner part 28 of the ring 18.

The ring 18 preferably comprises several particularly three reference features 46 for facilitating the connection of the burner 12 with the holder 16 in an optimal alignment. The reference features 46 may be bulges arranged on the upper surface 40 of the ring 18. Since the reference features 46 are one-piece with the legs 24 the correct alignment of the burner 12 with respect to the socket 14 is facilitated.

Since the drawings are drawn to scale specific length ratios of different elements of the invention can be derived by measuring the illustrated elements within one drawing.

While the invention has been illustrated and described in detail in the drawings and foregoing description, such illustration and description are to be considered illustrative or exemplary and not restrictive; the invention is not limited to the disclosed embodiments.

For example, it is possible to operate the invention in an embodiment wherein the ring 18 is not round or circular but angular in order to fit to an angularly shaped socket 14.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A high pressure discharge lamp comprising a high pressure discharge burner for emitting light said burner having a proximal end and a distal end;

a holder comprising a plurality of legs, by which the burner is supported at the proximal end;

a socket, to which the holder is mechanically connected;

whereby the holder comprises a ring, said ring being one-piece with at least one leg of said plurality of legs and surrounding the socket;

wherein the socket comprises protrusions that, when connected to the holder, are surrounded by the ring, each one of said plurality of legs extends a greater distance in a direction towards said distal end than the socket extends in said direction.

2. The high pressure discharge lamp according to claim 1, wherein the ring comprises an inner surface radially pointing towards the socket and at least one leg of said plurality of legs protrudes from the ring next to the inner surface.

3. The high pressure discharge lamp according to claim 1, wherein at least one leg of said plurality of legs is connected to the ring radially spaced outwards with respect to the socket.

4. The high pressure discharge lamp according to claim 1, wherein the ring comprises radially pointing surfaces and an axially pointing cooling surface, wherein the ratio of the area of the cooling surface to the area of radially pointing surfaces of the ring is $\geq 0.5$.

5. The high pressure discharge lamp according to claim 1, wherein the socket comprises a recess for arranging at least one leg of said plurality of lees.

6. The high pressure discharge lamp according to claim 1, wherein the ring comprises a cooling rip.

7. The high pressure discharge lamp according to claim 1, wherein the socket comprises a metal housing thermally connected to the holder.

8. The high pressure discharge lamp according to claim 7, wherein the holder is fixed to the housing.

9. The high pressure discharge lamp according to claim 7, wherein the holder is one-piece with the housing.

10. The high pressure discharge lamp according to claim 1, wherein the ring comprises radially pointing surfaces and an axially pointing cooling surface, wherein the ratio of the area of the cooling surface to the area of radially pointing surfaces of the ring is $\geq 1.0$.

11. The high pressure discharge lamp according to claim 1, wherein the ring comprises radially pointing surfaces and an axially pointing cooling surface, wherein the ratio of the area of the cooling surface to the area of radially pointing surfaces of the ring is $\geq 2.5$.

12. The high pressure discharge lamp according to claim 1, wherein the ring comprises radially pointing surfaces and an axially pointing cooling surface, wherein the ratio of the area of the cooling surface to the area of radially pointing surfaces of the ring is ≥3.5.

13. The high pressure discharge lamp according to claim 1, wherein the holder and/or a housing of the socket are made from a metal.

14. The high pressure discharge lamp according to claim 13, wherein the holder is one-piece with the housing.

15. The high pressure discharge lamp according to claim 1, wherein the burner comprises a bush; and at least one leg of said plurality of legs is fixed to said bush by a weld.

* * * * *